United States Patent [19]

Wrulich et al.

[11] Patent Number: 4,735,458

[45] Date of Patent: Apr. 5, 1988

[54] DEVICE FOR INTERMITTENTLY SUBJECTING AXIALLY SHIFTABLE BITS OF A CUTTING HEAD TO THE ACTION OF PRESSURIZED FLUIDS

[75] Inventors: Herwig Wrulich, Zeltweg; Franz Schöffmann, Leoben; Wilfried Maier, Zeltweg, all of Austria

[73] Assignee: Voest-Alpine Aktiengesellschaft, Linz, Austria

[21] Appl. No.: 852,162

[22] Filed: Apr. 15, 1986

[30] Foreign Application Priority Data

Apr. 18, 1985 [AT] Austria ..... A1166/85

[51] Int. Cl.[4] ..... F21C 35/22

[52] U.S. Cl. ..... 299/81; 251/208

[58] Field of Search ..... 299/94, 81, 17, 69, 299/70; 173/116; 251/208, 209

[56] References Cited

U.S. PATENT DOCUMENTS

| | | | |
|---|---|---|---|
| 3,741,316 | 6/1973 | Alajouanine | 173/116 X |
| 4,212,497 | 7/1980 | Borowski et al. | 299/81 X |
| 4,289,357 | 9/1981 | Hintermann et al. | 299/81 |
| 4,451,089 | 5/1984 | Paurat et al. | 299/81 X |
| 4,470,636 | 9/1984 | Pourat et al. | 299/81 |
| 4,471,998 | 9/1984 | Hotger | 299/81 |
| 4,555,143 | 11/1985 | Wrulich et al. | 299/69 X |
| 4,585,275 | 4/1986 | Wrulich et al. | 299/81 |
| 4,660,891 | 4/1987 | Krämer-Wasserka | 299/81 |

FOREIGN PATENT DOCUMENTS 0014695 5/1983 European Pat. Off. .

0122252 10/1984 European Pat. Off. .

*Primary Examiner*—Stephen J. Novosad
*Assistant Examiner*—David J. Bagnell
*Attorney, Agent, or Firm*—Cushman, Darby & Cushman

[57] ABSTRACT

The device for intermittently subjecting axially shiftable bits of a cutting head to the action of pressurized fluids comprises bit holders in which the bits are supported for a limited movement in axial direction. The bits are subjected to the action of a percussion piston which is intermittently supplied with pressurized fluid. A distributor 6 is provided for intermittently supplying pressure and includes a bushing-shaped distributing slide valve 18. The distributing slide valve 18 is provided in its mantle surface with radial perforations 22 which can be brought in alignment with passages 7 of a cutting head 3. There is provided an interpositioned gearing comprising a sun wheel 13, intermediate gear wheels 11 bearingly supported on a carrier 10 fixed for not being rotatable and a hollow gear wheel 15 non-rotatably connected with the cutting head 3. The bushing-shaped distributing slide valve 18 is non-rotatably connected with the sun wheel 13 being rotated in this manner by the cutting head 3, noting that the distributing slide valve 18 is rotated in a sense opposite to the sense of rotation of the cutting head 3. Supply of water is effected via an intermediate piece 20 into an axial water supply bolt 9 from which the water is intermittently supplied to the percussion pistons within the bit holders via the perforations 22 of the distributing slide valve 18.

8 Claims, 4 Drawing Sheets

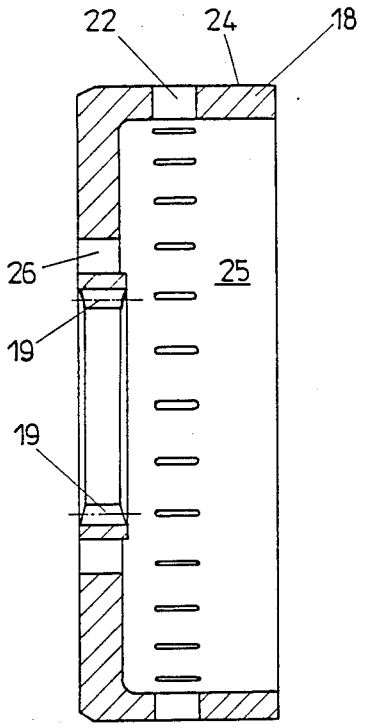
FIG. 3
FIG. 4
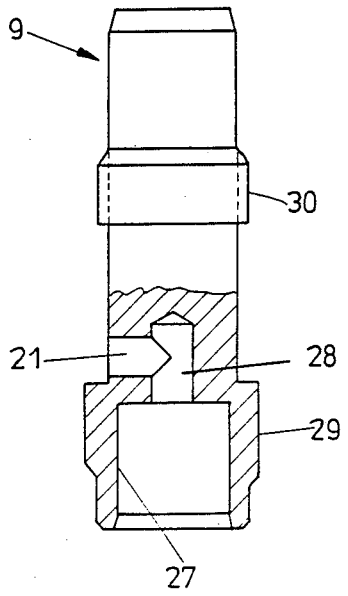

DEVICE FOR INTERMITTENTLY SUBJECTING AXIALLY SHIFTABLE BITS OF A CUTTING HEAD TO THE ACTION OF PRESSURIZED FLUIDS

BACKGROUND OF THE INVENTION

1. Field of the Invention

The invention refers to a device for intermittently subjecting axially shiftable bits of a cutting head to the action of pressurized fluid, in which device the bits are pressed in outward direction by a percussion piston under the action of the pressurized fluid and the percussion piston is retracted by the force of reaction of the bits with supply of pressurized fluid being deactivated.

2. Description of the Prior Art

Cutting heads of this type are used in partial cut cutting machines in which at least one cutting head is rotatably supported on a universally swivellable cutting arm. In most cases, two cutting heads are rotatably supported on such cutting arms for rotating around an axis crossing or intersecting the axis of the cutting arm. It is known to support the bits of such a cutting head for effecting a limited axial shifting stroke within bit holders, noting that the shifting movement of the bit has, for example, been used for opening a valve for the purpose of spraying water via nozzles onto the mine face.

From U.S. Pat. No. 4,555,143, the disclosure of which is incorporated herein by reference, there has already become known a process and a device for introducing water via distributing bolts into passages of a cutting head. In this known arrangement, the bit holder has a percussion piston arranged behind the bit and exerting, for the purpose of improving the efficiency of cutting work, a percussion action on the bit by being intermittently subjected to the action of pressurized fluid. The distributor provided in this known construction was arranged in proximity of the axis and stationary relative to the rotating cutting head. On account of the small dimension in radial direction of the distributor having substantially the shape of a bolt, only a low number of perforations could be provided along the circumference of the distributor, which resulted in only low impact frequencies. Cutting heads of the usually mentioned type are usually operated with relatively low rotating speed in the order of 60 rpm, so that the impact frequency observed was also limited on account of this fact.

SUMMARY OF THE INVENTION

The invention now aims at further developing a device of the type having become known from U.S. Pat. No. 4,555,143 such that high impact frequencies can be obtained without increasing the rotating speed of the cutting head. For solving this task, the invention essentially consists in that the supply of pressurized fluid is controlled by a distributing slide valve designed as a bushing comprising in its mantle surface perforations being adapted for being connectable with passages provided within the cutting head and leading to the working chambers of the percussion pistons, the distributing slide valve being not rotatable or being adapted for being driven with a rotating speed differing from the rotating speed of the cutting head. On account of the distributor for pressurized fluid being designed as a distributing slide valve having the shape of a bushing and having provided in its mantle surface a number of perforations, a greater number of exactly defined perforations can be provided in the mantle surface on account of the greater diameter now possible in this construction, so that, even if the distributing slide valve is non-rotatably connected with the bearing axis of the cutting head, the number of impacts per unit of time can essentially be increased. However, the impact frequency can still be substantially increased if the distributing slide valve can be rotated with a rotating speed differing from the rotating speed of the cutting head, noting that, in particular if distributing slide valve and cutting head are in accordance with a preferred embodiment of the device according to the invention rotated in the opposite sense, there results a substantial increase of the number of impacts per unit of time.

For driving the distributing slide valve being designed as a bushing, there is preferably provided a gearing, the distributing slide valve being driven for effecting rotating movement by the cutting head with interconnection of said gearing.

A particularly simple construction of the gearing, which construction allows to achieve a corresponding transmission ratio and a small space requirement, can be realized if the distributing slide valve is connected with a gear wheel, in particular has a internal gear being in meshing engagement with a central sun wheel, which gear wheel or sun wheel, respectively, can be driven by a part, of the cutting head, designed as a hollow gear wheel via intermediate gear wheels supported on a non-rotatable carrier. In this case the central sun wheel can immediately be rotatably supported on a non-rotating axial water supply bolt, so that one can do with a low number of constructional parts and the axial length of the construction can, furthermore, be kept extremely small. A particularly compact device can, in this case, be achieved if the carrier for the intermediate gear wheels is non-rotatably connected with the axial water supply bolt. On account of the bushing-like construction of the distributing slide valve, the gearing can, as a whole, be housed within the cavity of the distributing slide valve being designed as a bushing. The whole device is thus constructed only in radial direction, thereby not requiring any substantial increase of the constructional length in axial direction as compared with the known construction according to U.S. Pat. No. 4,555,143. The space provided by arranging the passages of the distributing slide valve along a greater diameter is fully utilized in radial direction.

For the purpose to make sure that the pressure drop becomes not too great and the full impact energy is at disposal if a plurality of perforations are provided in the distributing slide valve at equal distances in direction of the circumference and if a plurality of connections for the passages to the individual bit holders is equally distributed at equal distances along the circumference, the construction of the distributing slide valve is advantageously such that the greatest common divisor of the number of perforations of the distributing slide valve and of the number of passages of the cutting head connectable to said perforations is 2 to 5, preferably 3, noting that the passages as well as the perforations are each arranged at equal distances in direction of the circumference. In this manner, the maximum number of percussion pistons being subjected to the action of pressurized fluid is 2 to 5, preferably 3, so that nearly the whole power is at disposal for each bit engaging the drift face. The pressurized fluid is, as a rule, supplied in the form of water being pressurized to approximately 200 bar and can simultaneously be ejected via corresponding throttle bores or be ejected via nozzles only during the retraction stroke of the percussion pistons under the action of the force of reaction of the bits, so that dust removal is highly effective and excessive temperatures are avoided.

In an embodiment, in which the bushing-shaped distributing slide valve can be rotated in opposite sense relative to the cutting head, up to two hundred interruptions of pressure can be achieved with a construction according to the invention, so that a percussion effect of correspondingly high frequency can be obtained. In this case and with a rotating speed of the cutting head of approximately sixty revolutions per minute, the bushing-shaped distributing slide valve has distributed over its circumference approximately fourty slots having the shape of elongated slots extending in axial direction. By means of a suitable gearing, the bushing-shaped distributing slide valve attains a rotating speed, of opposite sense, of approximately 150 rpm.

BRIEF DESCRIPTION OF THE DRAWING

In the following the invention is further explained with reference to an embodiment schematically shown in the drawing.

In the drawing

DETAILED DESCRIPTION OF THE PREFERRED EMBODIMENT

Figure 1:
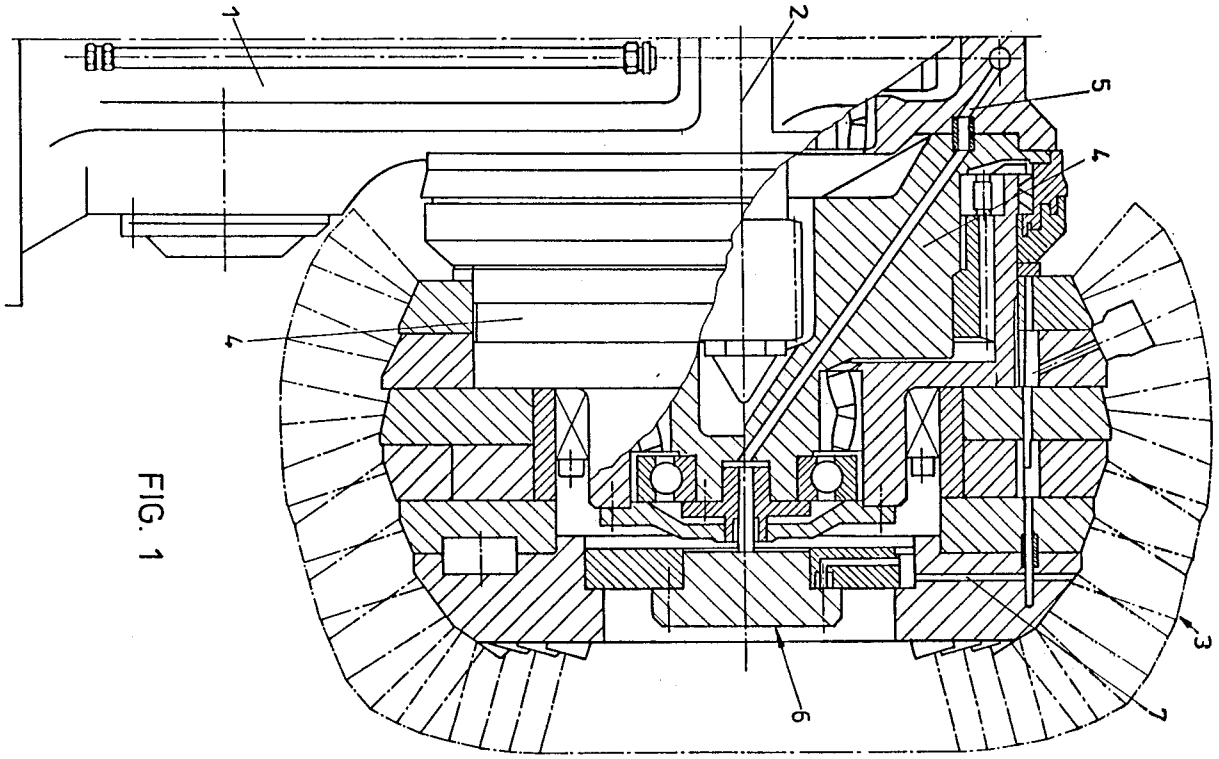
FIG. 1 shows, partially in a section, a cutting head rotatably supported on a cutting arm, FIG. 2 the distributing slide valve and its drive means in an axial section and in an enlarged scale, FIG. 3 the distributing slide valve in an axial section, FIG. 4 water supply bolt, partially in a section.

In FIG. 1, a cutting arm designated by 1 has rotatably supported thereon a cutting head 3 for being rotatable around an axis 2. Within the interior of the cutting head 3, there is arranged at least the last stage of a cutting gearing 4 for deriving therefrom the rotating movement of the cutting head 3. A water supply opens into the interior of the cutting head 4, is schematically designated by 5 and passes over into a distributor 6 in the axial area. Passages 7 can be connected to the distributor 6 for supplying water from the interior of the cutting heads to the bit holders and ejection nozzles of the cutting head, respectively.

Figure 2:
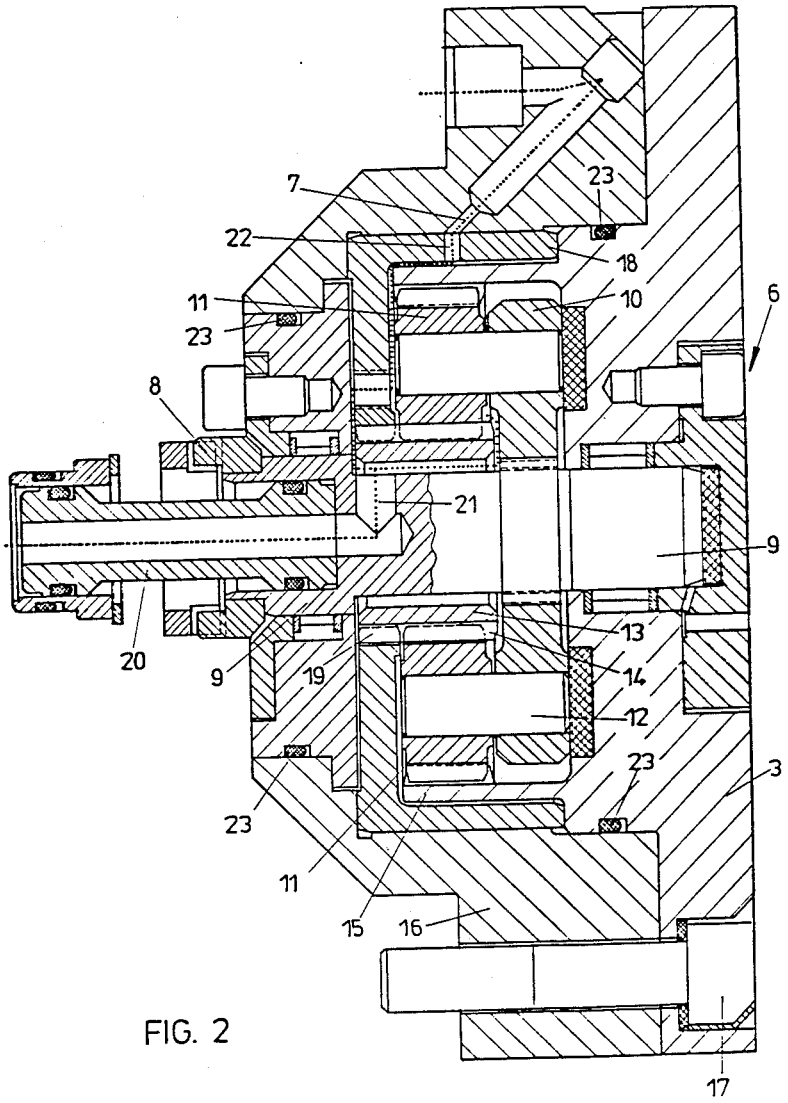

In the representation according to FIG. 2, the distributor 6 is shown in an enlarged scale. The distributor 6 includes a water supply bolt 9 being prevented from being rotated by means of claws 8. For compensating any eccentric load, an intermediate piece 20 is provided which reliably provides a tight connection of the water supply conduit 5 to the water supply bolt 9. A carrier 10 for gear wheels 11 is non-rotatably mounted on the stationary water supply bolt 9. The bearing axes, connected with the carrier 10, for the gear wheels 11 are designated by 12.

A sun wheel 13 is rotatably supported on the mantle surface of the water supply bolt 9 and has its teeth 14 meshing with the teeth of the intermediate gear wheels 11. The intermediate gear wheels 11 are, at the opposite side, in meshing engagement with a hollow gear wheel 15 which is non-rotatably connected with that part 16 of the cutting head 3 which is driven for being rotated. A screw 17 provides the required non-rotatable connection.

The hollow gear wheel 15 thus rotates with the same angular velocity as rotates the cutting head 3. This rotating movement is transmitted to the sun wheel 13 via the intermediate gear wheels 11 mounted on the rigid carrier 10, so that the sun wheel is rotated in opposite sense relative to the cutting head and with a greater angular velocity than the cutting head. Now, a bushing-shaped distributing slide valve 18 is non-rotatably connected with sun wheel 13, for which purpose toothing 19 of this bushing-shaped distributing slide valve 18 is in meshing engagement with the toothing 14 of the sun wheel 13. The bushing-shaped distributing slide valve 18 is thus rotated with the same angular velocity as is rotated the sun wheel 13.

The water arrives in the water supply bolt 9 via the intermediate piece 20 and into the gearing chamber of the drive means for the bushing-shaped distributing slide valve 18 via a radial bore 21 of the water supply bolt 9.

The bushing-shaped distributing slide valve 18 has in its mantle perforations 22 which can be brought in alignment with passages 7 of the cutting head. The water supply cavity within the interior of the distributing slide valve 18 is tightly sealed by the constructional part 16 of the cutting head 3, the sealing being designated by 23.

In FIG. 3, the bushing-like distributing slide valve 18 is shown alone. The perforations 22 formed of elongated slots and arranged in the mantle surface 24 are distributed at equal distances over the circumference of the bushing-shaped distributing slide valve 18. The internal toothing 19, which meshes with the outer toothing 14 of the sun wheel 13, allows the water to flow into the cavity 25 within the interior of the bushing-shaped distributing slide valve 18 as well as to the outer side, said water being given the possibility to again return into the interior space 25 of the distributing slide valve 18 via bores 26 provided in the front wall.

In FIG. 4, the water supply bolt 9 is shown alone. The water supply bolt 9 has a coupling cavity 27 for sealingly receiving the intermediate piece 20. This coupling cavity is first continued by an axial bore 28 into which open the radial passages 21. The sun wheel 13 is supported on the outer surface 29 of the water supply bolt 9 for free rotation. The carrier 10 for the intermediate wheels 11 is non-rotatably connected with an annular rim 30 for example formed of a toothed rim.

Figure 5:
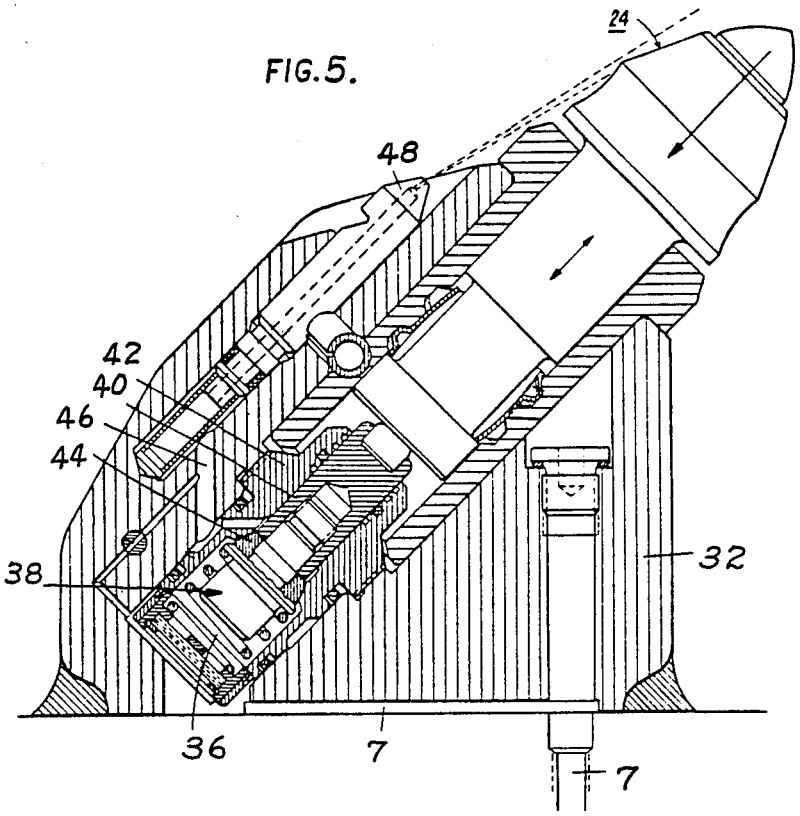
FIG. 5 is a cross-sectional view through a bit holder, showing a valve in the form of a piston and cylinder unit.

In FIG. 5 there is shown a bit holder 32 supporting a bit 34. From one of the passages 7 (FIGS. 1 and 2) water flows into a working space 36 of a hydraulic piston-and-cylinder unit 38 which functions as a valve. The unit 38 includes a percussion piston 40 and a cylinder 42 having a valve seat 44. When the valve is open, water flows through a channel 46 to a nozzle 48.

What is claimed is:

1. Device for intermittently subjecting axially shiftable bits of a rotatable cutting head to the action of pressurized fluid, said cutting head having internal passages, in which device each bit is pressed in outward direction by a percussion piston under the action of the pressurized fluid and the percussion piston is retracted by the force of reaction of the bits with a work face upon deactivation of the supply of pressurized fluid, said percussion pistons having working chambers, characterized in that the supply of pressurized fluid is controlled by a distributing slide value designed as a bushing having a mantle surface and comprising in its mantle surface perforations adapted for being connectable with said internal passages and leading to the working chambers of the percussion pistons, the distributing slide valve being adapted for being driven with a rotating speed differing from the rotating speed of the cutting head.

2. Device as claimed in claim 1, characterized in that the distributing slide valve is adapted for being rotated by the cutting head with interposition of gearing between said valve and said cutting head.

3. Device as claimed in claim 1, characterized in that the distributing slide valve can be rotated in a sense opposite to the sense of rotation of the cutting head.

4. Device as claimed in claim 1, characterized in that the distributing slide valve is connected with a gear wheel by means of internal teeth which are in meshing engagement with a central sun wheel, one of said gear wheel or sun wheel being adapted for being driven by a hollow gear wheel of the cutting head via intermediate gear wheels which are bearingly supported on a non-rotatable carrier.

5. Device as claimed in claim 4, characterized in that the sun wheel is rotatably supported on a non-rotatable axial water supply bolt (9).

6. Device as claimed in claim 4, characterized in that the carrier for the intermediate gear wheels is non-rotatably connected with an axial water supply bolt.

7. Device as claimed in claim 1, characterized in that the greatest common divisor of the number of perforations of the distributing slide valve and of the number of passages of the cutting head, connectable to said perforations is 2 to 5, the passages as well as the perforations being arranged at equal distances in direction of the circumference.

8. In a cutting head for a cutting machine, said cutting head being rotatable about an axis and having a plurality of radially outwardly extending internal water delivery passages arranged in a circular pattern about said axis, said delivery passages having inner ends and having outer ends for delivering water to the periphery of said cutting head; a water supply passage in said cutting head, said supply passage terminating in a non-rotatable fitting located on said axis of rotation, said fitting having at least one water outlet opening therein; a rotatable slide valve having an annular part coaxial with and surrounding at least a portion of said fitting and forming a water cavity for receiving water from said water outlet opening, said annular part having circumferentially spaced-apart, radially extending perforations communicating with said water cavity and alignable with the inlet ends of said water delivery passages upon relative rotation between said slide valve and said cutting head; and means for rotating said slide valve at a speed different from the speed of said cutting head.

* * * * *